United States Patent [19]

Noschese

[11] Patent Number: 4,912,841

[45] Date of Patent: Apr. 3, 1990

[54] DENSE WIRE BUNDLE EXTRACTING TOOL

[75] Inventor: Rocco Noschese, Wilton, Conn.

[73] Assignee: Burndy Corporation, Norwalk, Conn.

[21] Appl. No.: 254,458

[22] Filed: Oct. 6, 1988

[51] Int. Cl.[4] ..... H01R 43/22

[52] U.S. Cl. ..... 29/764; 29/758; 294/19.1; 294/100

[58] Field of Search ..... 294/100, 19.1, 103.1, 294/104, 115, 116; 29/758, 764

[56] References Cited

U.S. PATENT DOCUMENTS

| | | | |
|---|---|---|---|
| 1,938,419 | 12/1933 | Freidlein | 294/100 |
| 2,931,680 | 4/1960 | Kaspaul | 294/100 |
| 3,093,402 | 6/1963 | Sisson | 294/100 |
| 3,136,040 | 6/1964 | Bauer | 29/764 |
| 3,197,849 | 8/1965 | Johnson | 29/764 |
| 3,380,141 | 4/1968 | Rofer | 29/764 |
| 3,451,117 | 6/1969 | Cameron | 29/764 |

*Primary Examiner*—Johnny D. Cherry
*Attorney, Agent, or Firm*—Perman & Green

[57] ABSTRACT

A tool for extracting one lead including a cable and its associated contact from a dense grouping of leads connected to a receptacle. In this instance, each contact is held in position in an associated bore of the receptacle by means of a locking tab integral with the receptacle and engaged with an annular shoulder on the contact to prevent its inadvertent removal. The tool is readily attachable to the cable, then said along the cable until extraction jaws are caused to engage the contact. They displace the locking tab and permit withdrawal of the lead from the receptacle. Subsequently, the jaws can be opened and removed from the cable. A reverse procedure can be utilized for returning the contact to its original position or inserting a new contact in its place.

9 Claims, 3 Drawing Sheets

104
102
72
90
26
60
92
72
90
88
76
78
82
80
26
20
24
22

DENSE WIRE BUNDLE EXTRACTING TOOL

BACKGROUND OF THE INVENTION

1. Field of the Invention

The present invention relates to a tool for extracting a specific contact terminating a specific miniature lead from a receptacle receiving a dense grouping of such leads. While the disclosure is generally directed to the description of a tool utilized for gaining access to, removing, and subsequently replacing a contact for a coaxial lead, the scope of the invention is not intended to be limited only to coaxial leads and their contacts but to all types of electrical leads and their contacts which are part of a dense grouping of such leads and contacts. Accordingly, all references herein to coaxial leads and their contacts are illustrative only and are not to be limiting of the invention.

2. Description of the Prior Art

Requirements of backplane interconnections for electronic data processing and telecommunications applications call for ever increasing numbers of electrical leads to accommodate an ever larger number of signals within a given unit of space. At the same time, the space limitations are ever decreasing with the result that there are ever denser groupings of such leads. This has led to extreme miniaturization which has made it more and more difficult to locate and extract an individual lead when it becomes necessary or desirable. A similar difficulty is experienced when it becomes necessary or desirable to reinsert an individual lead in the proper location of the receptacle to which the grouping of leads is connected.

A typical electrical connector assembly is disclosed in commonly assigned U.S. patent application Ser. No. 254,436 filed Oct. 6, 1988, of Michael Lazar and Rocco Noschese, entitled "Controlled Impedance Plug and Receptacle". According to the foregoing disclosure, a terminal is mounted to the extremity of each of plurality of leads, which may be coaxial leads, and is removably received in an associated terminal receiving bore with a locking spring which is utilized to prevent inadvertent removal of the terminal but which is subject to manipulation to enable purposeful removal of the terminal. Such purposeful removal, which is desirable from time to time, has become difficult at best and well nigh impossible when attempted manually with the lead densities currently being practiced.

SUMMARY OF THE INVENTION

The present invention was conceived and has now been reduced to practice in order to satisfy the need for removing and reinstalling miniaturized leads which are utilized in such dense groupings as has just been described. To this end, the invention relates to a tool for extracting one coaxial lead, including a cable and its associated contact, from a dense grouping of leads connected to a receptacle. In this instance, each contact is held in position in an associated bore of the receptacle by means of a locking tab integral with the receptacle and engaged with an annular shoulder on the contact to prevent its inadvertent removal. The tool is readily attachable to the cable, then slid along the cable until extraction jaws are caused to engage the contact.

They displace the locking tab and permit withdrawal of the coaxial lead from the receptacle. Subsequently, the jaw can be opened and removed from the cable. A reverse procedure can be utilized for returning the contact to its original position or for inserting a new contact in its place.

Indeed, the tool of the invention is intended to enable an operator to gain access to the terminal end of a lead through a thick bundle of such leads which may well be in excess of a foot deep. In such a situation, entry of the operator's hand to reach the contact would be impossible. However, by reason of the invention, the operator's hand is remote from the extraction jaws of the tool but the operator is nonetheless able to accurately locate the contact being sought and to rapidly and easily remove it and similarly replace it in a reverse procedure.

Features of the invention include the ease with which it can be used, achieving the desired result in a rapid manner and with accuracy. At the same time, the tool of the invention is safe in that it can be used without causing harm either to the user or damage to the lead being sought, to adjoining leads, or to the receptacle from which the lead is to be drawn. Additionally, the tool is inexpensive to manufacture and requires essentially no maintenance to assure its continued operation.

Other and further features, objects, advantages, and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated herein and constitute a part of this invention, illustrate one of the embodiments of the invention and, together with the description, serve to explain the principles of the invention in general terms. Like numerals refer to like parts throughout the disclosure.

DETAILED DESCRIPTION OF THE PREFERRED EMBODIMENT

It was previously explained that the tool of the invention is useful for removal of electrical leads, such as coaxial leads, from, or for their insertion to, the receptacle of the connector assembly generally as disclosed in copending application of Michael Lazar and Rocco Noschese, Ser. No. 254,436, to which reference has previously been made. Turn now to the drawings, and initially to FIGS. 1–3, for a brief description of such a typical connector assembly 20.

Figure 3:
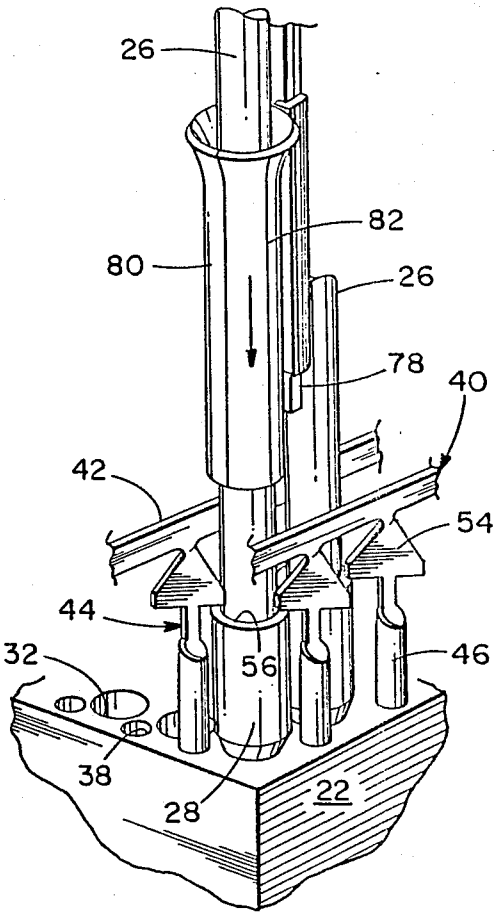
FIG. 3 is a detail perspective view illustrating the use of the extraction tool with the connector assembly illustrated in FIG. 2.
Figure 2:
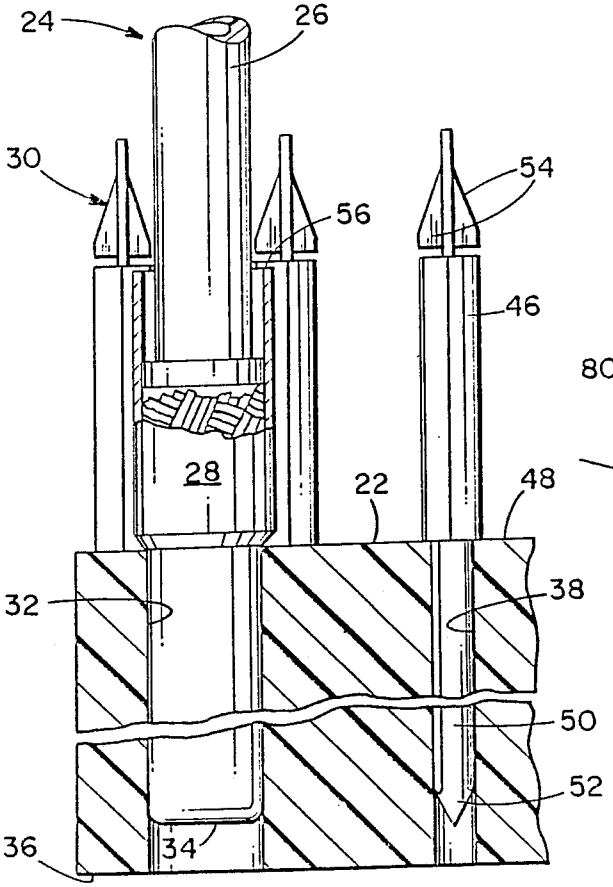
FIG. 2 is a detail side elevation view, partially cut away and in section illustrating a typical connector assembly with which the extraction tool of the invention may be utilized.

It will be understood that only those components of the connector assembly which relate to the present invention will be described and illustrated. Thus, a mounting block 22 is illustrated which serves as a receptacle for a dense grouping of coaxial leads 24, each of which includes a coaxial cable 26 which is terminated by means of a coaxial contact 28 (FIGS. 2 and 3). A locking mechanism 30 serves to releasably fix each of the coaxial contacts 28 in an associated contact receiving bore 32 formed in the mounting block 22.

The locking mechanism 30 serves to assure that all of the tip ends 34 of the contacts 28 (FIG. 2) lie substantially in a common plane spaced from and generally parallel to a front face 36 of the mounting block 22. To this end, the mounting block 22 has a plurality of locking throughbores 38 therein (FIG. 3) at spaced locations and generally parallel with the terminal receiving bores 32. An expedient used in conjunction with the locking throughbores 38 is a locking strip 40 which may be composed of a stamped metal sheet, although it could also be of molded plastic or other suitable resilient material.

In any event, the locking strip 40 includes an elongated common member 42 and a plurality of elongated locking members 44 integral with the common member and extending transversely therefrom at spaced parallel locations. Each of the locking members 44 includes a central support element 46 which may be rolled to have a diameter slightly larger than that of the its associated throughbore 38. In this manner, the central support element 46 is engageable with a rear face 48 of the mounting block 22 when a tail 50 integral with and extending away from the central support element is received in the throughbore.

Outwardly and oppositely extending retention barbs 52 are formed near the tip end of each tail 50 and engage the sidewall of the throughbore 38. These barbs serve to temporarily hold the locking strip 40 until it can be permanently affixed to the mounting block 22. A pair of resilient locking tabs 54 are integral with and extend away from the central support element 46. In their relaxed locking condition, the locking tabs 54 are intended to be positioned so as to overlie associated contact receiving bores 32 adjacent to the tail receiving locking throughbore 38 when the locking strip 40 is in its operative position.

When it is intended that the locking strip 40 is to be affixed to the mounting block 22, the tails 50 are received in their associated locking throughbores 38 such that the central support elements 46 rest on the rear face 48. Thereupon, epoxy or other suitable bonding material is directed into the throughbores 38 so as to fixedly bond the tails 50 to the mounting block 22. A plurality of locking strips 40 are thus affixed to the mounting block 22 and lie in parallel, spaced apart planes.

Figure 4:
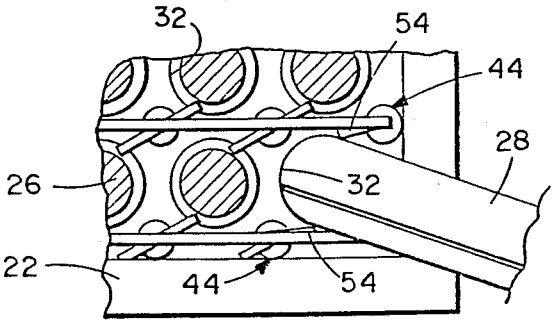
FIG. 4 is a detail top plan view, certain parts being shown in section, illustrating the locking mechanism used by the connector assembly depicted in FIGS. 2 and 3.

As a contact 28 is inserted into its associated bore 32 (see FIG. 4), opposed locking tabs 54 from two adjacent locking members 44 overlying that particular bore are caused to deflect out of the way to a release position to permit reception by the bore of its associated contact. However, when the contact 28 is in its fully inserted position such that an extreme aft rim 56 of the contact moves past the tabs 54 (FIGS. 2 and 3), the tabs return to their locking positions engageable with the aft rim to prevent subsequent withdrawal of the contact from its fully inserted position as illustrated. However, it will be appreciated that by manually deflecting the tabs 54, associated contacts 28 can once again be withdrawn from the mounting block 22. Thus, the locking strip 40 serves to prevent inadvertent removal of a plurality of contacts 28 while permitting their individual withdrawal when specifically intended.

Figure 1:
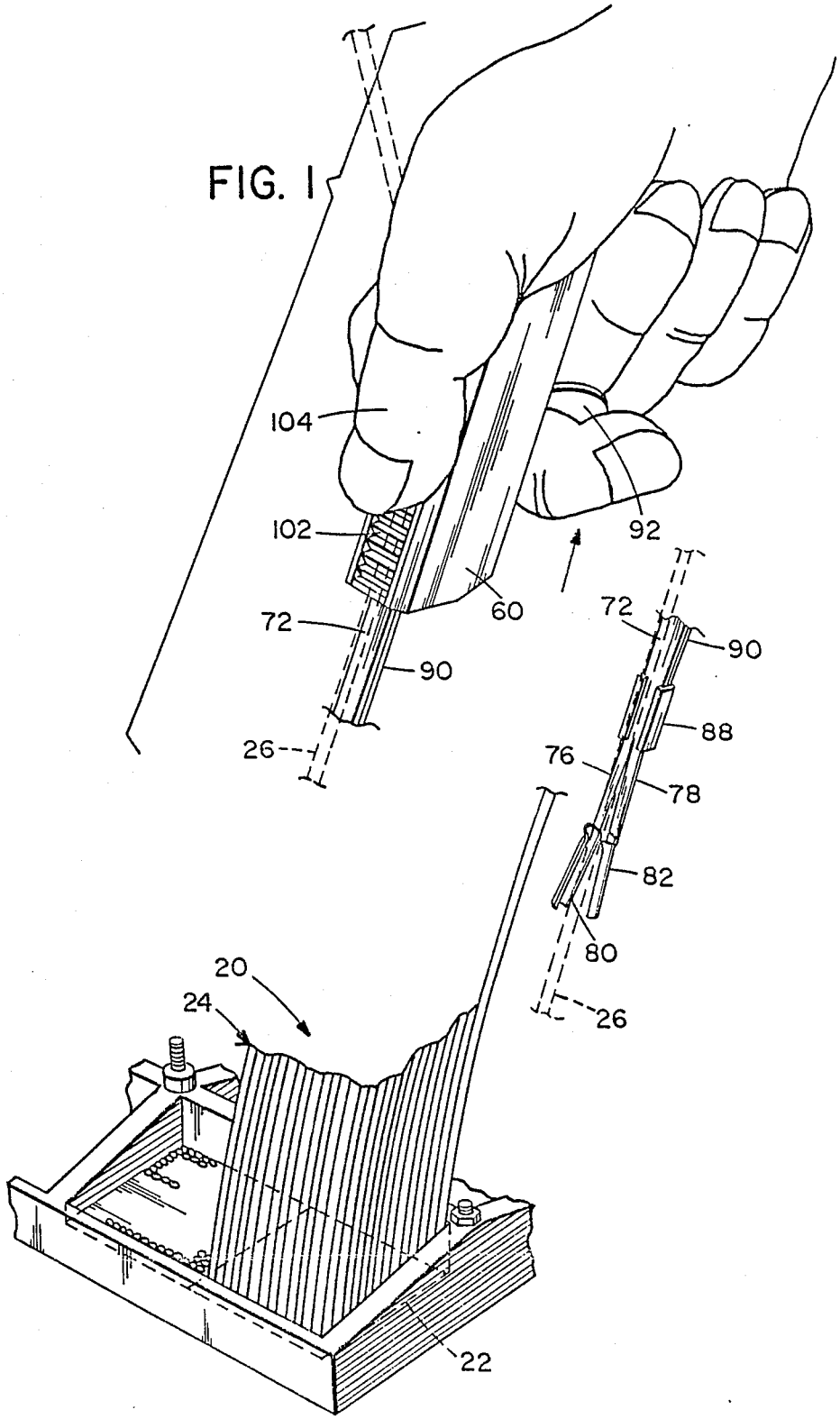
FIG. 1 is a perspective view generally illustrating the operation of an extraction tool embodying the present invention.

However, in the absence of the invention, a substantial difficulty remains when it is desired to remove an individual lead from a dense grouping of leads as illustrated in FIG. 1. Specifically the grouping of leads is so dense and the leads so small that attempts to remove an individual lead manually would be unsuccessful. Hence the need for this invention.

An extraction tool 58 which is particularly well suited for removal of individual leads from such dense groupings is illustrated in FIGS. 5–8. The extraction tool 58 includes a handle 60 which is formed with an internal cavity 62 (FIG. 6) which extends between a forward wall 64 and a rearward wall 66. The cavity 62 is open to the environment via a longitudinally extending slot 68 in the underside of the handle.

An elongated extraction member 70 includes a bar 72 which extends in a fitting fashion through an aperture 74 at a forward end of the handle 60. The bar 72 is transversely bent at its rearward end to define an ear 75 held in engagement against the rearward wall 66. At its opposite end, the bar 72 is birfurcated into a pair of opposed extraction elements 76, 78 which are normally biased apart.

A pair of mating extraction jaws 80, 82 are fixed, respectively, to the extraction elements 76, 78 in an aligned fashion. Each extraction jaw is of a tubular configuration having a semicircular cross section such that when the halves represented by each of the extraction jaws 80, 82 are placed together as seen in FIG. 3, they have a circular cross section with an inner diameter slightly larger than that of the coaxial cable 26. Aft ends 84, 86 of the extraction jaws 80, 82, respectively, are desirably flared to enable manipulation of the cable 26 in a manner to be described. The flared design also serves to minimize chafing or cutting of the cable during handling.

Figure 9:
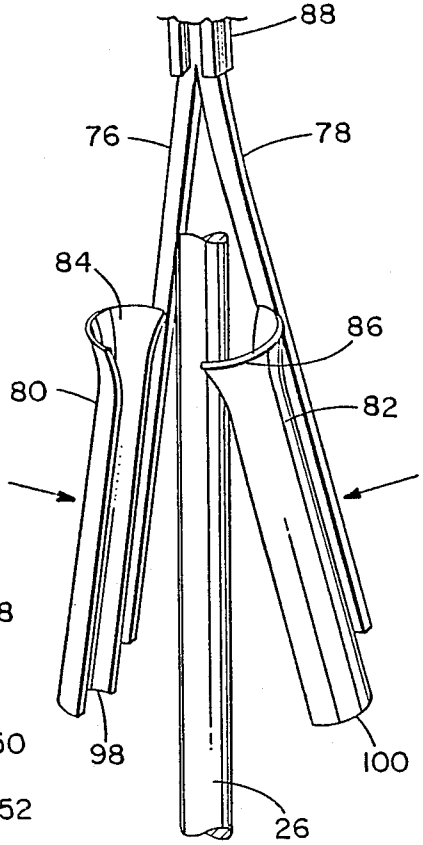
FIG. 9 is a detail perspective view illustrating the open position of the extraction jaws which form a part of the extraction tool of the invention.
Figure 8:
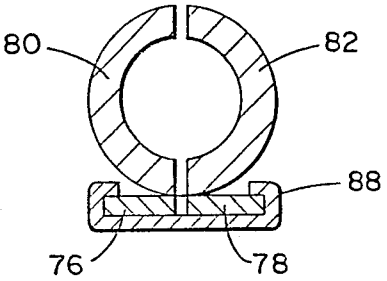
FIG. 8 is a cross section view taken generally along line 8—8 in FIG, 5.
Figure 7:
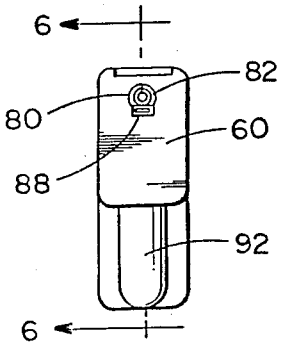
FIG. 7 is a front elevation view of the tool illustrated in FIGS. 5 and 6.

An actuating mechanism is operably associated with the elements 76, 78 to move the jaws 80, 82 between the open (FIG. 9) and closed (FIG. 3) positions. It includes a closure member 88, an extension member 90, a trigger 92, and a compression spring 94. As best seen in FIGS. 1 and 8, the closure member 88 is generally C-shaped for slidable reception on the bar 72. The extension member 90 is integral with the closure member 88 and extends rearwardly therefrom aligned and in contiguous relationship with bar 72. The extension member 90 extends through the aperture 74 and at its extreme rear end is transversely bent into a finger 96 suitably fixed to the trigger 92.

The trigger 92 has a main body part which is slidably received along the slot 68 of the handle 60 and a finger actuated portion which extends outwardly from beneath the handle. The compression spring 94 is located within the cavity 62 and extends between the ear 75 and the main body of the trigger 92 so as to urge the trigger into engagement with the forward wall 64. Thus, when the trigger 92 is in the position illustrated in FIG. 6, the closure member 88 is in engagement with the elements 76, 78, holding them in the closed position as best illustrated in FIGS. 3 and 8. When a user draws the trigger 92 to a rear position as illustrated by the dotted lines in FIG. 5, the closure member 88 is similarly moved along the bar 72 to the position illustrated in FIGS. 1 and 9 and to the dotted line position illustrated in FIG. 5, thereby opening the jaws 80, 82.

Figure 5:
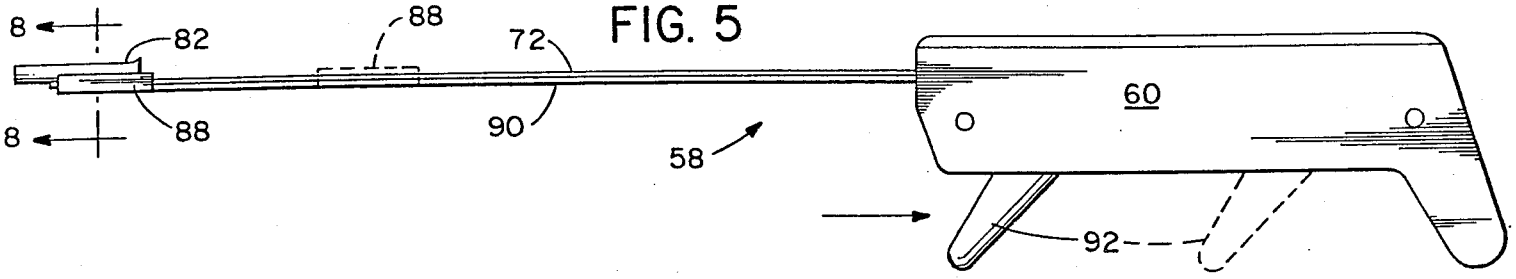
FIG. 5 is a side elevation view of the extraction tool embodying the invention.
Figure 6:
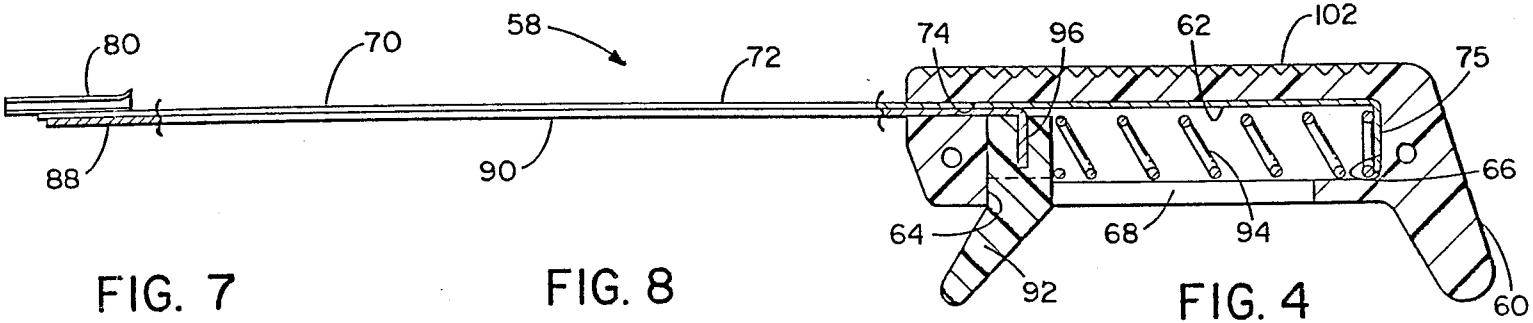
FIG. 6 is a longitudinal cross section view of the tool illustrated in FIG. 5.

When it is desired to withdraw a particular coaxial lead 24 from the mounting block 22 to which a large grouping of such leads is attached (see FIG. 1), the trigger 92 is moved against the bias of the spring 94 to the dotted line position illustrated in FIG. 5. This movement enables the jaws 80, 82 to move to the open position illustrated in FIGS. 1 and 9. Thereupon, the opened jaws are advanced to the region of the coaxial cable 26 at a location distant from the mounting block 22. When the jaws 80, 82 properly straddle the cable, the trigger 92 can be released thereby causing the jaws to close about and envelop a length of the cable equivalent to that of the jaws. Since the inner diameter of the closed jaws 80, 82 is slightly larger than the outer diameter of the cable 26, the handle 60 and the jaws 80, 82 can be advanced along the cable until forwardmost ends 98, 100 of the jaws 80, 82 move into engagement with the locking tabs 54, pushing or camming them aside, generally in the manner illustrated in FIG. 4 with respect to contact 28. Thereafter, the ends 98, 100 continue to advance until they engage the aft rim 56 (FIGS. 2 and 3) of the contact 28. It is preferable, although not mandatory, that the outer diameter of the jaws 80, 82 be substantially similar to that of the contact 28. In actual fact, the outer diameter of the jaws 80, 82 may be greater than that of the contact 28, but they should not be smaller than the outer diameter of the contact, else they will not deflect the tabs 54 to a sufficient extent to enable withdrawal of the contact past the tabs in a direction away from the mounting block 22.

When the ends 98, 100 of the jaws 80, 82 are engaged with the aft rim 56 of the contact 28, the user is able to manipulate the lead 26 so that it overlies an upper, longitudinally extending, surface 102 which is preferably roughened as by serrations, or the like. The flared aft ends 84, 86 increase the ease of such manipulations and readily allow the cable 26 to be laid along and in engagement with the upper surface 102 after which the user's thumb 104 (FIG. 1) firmly grips the cable and holds it fast in engagement with the handle. Thereupon, the user, holding the handle 60 and the individual cable 26 as a unit, withdraws both items simultaneously from the block 22 and causes the contact 28 to be freely withdrawn from the bore 32. The entire operation is performed without harm to the lead being withdrawn, to adjacent leads, or to the user. When the coaxial lead 24 has been withdrawn a substantial distance from the block 22, the trigger 92 is again operated for movement to the dotted line position of FIG. 5 thereby enabling the jaws 80, 82 to be opened and released from the cable 26.

The extraction tool 58 may be used in an opposite manner to insert into a bore 32 of the mounting block 22 a coaxial contact 28 terminating a particular coaxial lead 24 should that be desirable. The tool 58 enables such an operation to be performed in a dense grouping of coaxial leads 24 when the fingers of a person would be unable to perform the operation.

While a preferred embodiment of the invention has been disclosed in detail, it should be understood by those skilled in the art that various modifications may be made to the illustrated embodiment without departing from the scope as described in the specification and defined in the appended claims.

What is claimed is:

1. A tool for extracting one lead including a cable and its associated contact from a dense grouping of leads connected to a receptacle, each contact being held in position in an associated bore of the receptacle by means of a locking tab integral with the receptacle and engaged with an annular shoulder on the contact to prevent its inadvertent removal, said tool comprising:

extraction means including jaw means movable between an open position removed from the cable and a closed position, said jaw means, when in the closed position, having an outer diameter at least substantially equal to that of the contact at its annular shoulder and an inner diameter slightly larger than that of the cable and of the contact adjacent its annular shoulder, said jaw means, when in the closed position, being slidably receivable on the cable for movement therealong, whereby upon movement of said jaw means in the closed position along the cable and into engagement with the contact, the locking tab is caused to be disengaged from the annular shoulder enabling unitary withdrawal of the lead and said tool from the receptacle.

2. An extraction tool as set forth in claim 1 including:

actuating means operably associated with said extraction means for moving said jaw means between the open and closed positions.

3. An extraction tool as set forth in claim 1 including:

a handle; and wherein said extraction means includes:

an elongated extraction member fixed to said handle at one end and being bifuracted at an end distant from said handle to define first and second extraction elements which are biased apart; and wherein said jaw means includes:

first and second mating extraction jaws fixed, respectively, to said first and second extraction elements movable with said extraction elements between an open position spaced apart and a closed position for cooperatively substantially enveloping a finite length of the cable.

4. An extraction tool as set forth in claim 3 including:

actuating means operably associated with said extraction means for moving said jaw means between the open and closed positions.

5. An extraction tool as set forth in claim 4 wherein said actuating means includes:

a closure member slidably received on said extraction member movable between a withdrawn position distant from said extraction jaws whereat said extraction jaws are in the open position and an advanced position adjacent said extraction jaws whereat said extraction jaws are in the closed position.

6. An extraction tool as set forth in claim 5 wherein said handle has an internal cavity extending between a forward wall and a rearward wall; and including:

a trigger slidably received within the internal cavity and extending outwardly of said handle;

a compression spring in the cavity extending between said trigger and said rearward wall and biasing said trigger toward said forward wall; and an operating extension member fixed at one end to said trigger and fixed at its opposite end to said closure member.

7. An extraction tool as set forth in claim 6 wherein said handle has a roughened outer surface against which the cable can be gripped when the lead and said tool are withdrawn from the receptacle.

8. A tool for extracting one lead including a cable and its associated contact from a dense grouping of leads connected to a receptacle, each contact being held in position in an associated bore of the receptacle by means of a locking tab integral with the receptacle and engaged with an annular shoulder on the contact to prevent its inadvertent removal, said tool comprising:

a handle having an internal cavity extending between a forward wall and a rearward wall;

an elongated extraction member fixed to said handle at one end and being bifuracted at an end distant from said handle to define first and second extraction elements which are biased apart;

first and second mating extraction jaws fixed, respectively, to said first and second extraction elements movable with said extraction elements between an open position spaced apart and a closed position for cooperatively substantially enveloping a finite length of the cable;

a closure member slidably received on said extraction member movable between a withdrawn position distant from said extraction jaws whereat said extraction jaws are in the open position and an advanced position adjacent said extraction jaws whereat said extraction jaws are in the closed position;

a trigger slidably received within the internal cavity and extending outwardly of said handle;

a compression spring in the cavity extending between said trigger and said rearward wall and biasing said trigger toward said forward wall;

an operating extension member fixed at one end to said trigger and fixed at its opposite end to said closure member;

whereby movement of said trigger toward said rearward wall against the bias of said compression spring moves said closure member to the withdrawn position resulting in movement of said extraction jaws to the open position; and whereby subsequent release of said trigger causes movement thereof toward said forward wall under the influence of said compression spring resulting in movement of said extraction jaws to the closed position to envelop the cable therein; and whereby movement of said extraction jaws along the cable and into engagement with the annular shoulder on the contact causes the locking tab to be disengaged therefrom thereby enabling unitary withdrawal of the lead and said tool from the receptacle.

9. An extraction tool as set forth in claim 8 wherein said handle has a roughened outer surface against which the cable can be gripped when the lead and said tool are together withdrawn from the receptacle.

* * * * *